US012791222B2

(12) United States Patent
Ulrich et al.

(10) Patent No.: US 12,791,222 B2
(45) Date of Patent: Nov. 10, 2026

(54) SENSOR DEVICE AND CONDENSATE WATER REMOVAL DEVICE

(71) Applicant: REFCO Manufacturing Ltd., Hitzkirch (CH)

(72) Inventors: Manfred Ulrich, Kastanienbaum (CH); Michael Oswald, Lucerne (CH)

(73) Assignee: REFCO Manufacturing Ltd., Hitzkirch (CH)

( * ) Notice: Subject to any disclaimer, the term of this patent is extended or adjusted under 35 U.S.C. 154(b) by 416 days.

(21) Appl. No.: 18/202,491

(22) Filed: May 26, 2023

(65) Prior Publication Data

US 2023/0383990 A1 Nov. 30, 2023

(30) Foreign Application Priority Data

May 30, 2022 (DE) ..... 10 2022 113 586.1

(51) Int. Cl.
*F24F 13/22* (2006.01)
*F24F 11/30* (2018.01)
*F24F 140/30* (2018.01)

(52) U.S. Cl.
CPC ..... *F24F 13/222* (2013.01); *F24F 11/30* (2018.01); *F24F 2013/227* (2013.01); *F24F 2140/30* (2018.01)

(58) Field of Classification Search
CPC .... F24F 13/222; F24F 11/30; F24F 2013/227; F24F 2140/30; F24F 11/32; F24F 11/88; F24F 11/89; F24F 13/22; F24F 11/54; G01V 8/20; G01V 9/00
See application file for complete search history.

(56) References Cited

U.S. PATENT DOCUMENTS 4,946,242 A * 8/1990 Tanno et al. ..... G01F 23/2927 356/28
10,031,041 B2 * 7/2018 Franz et al. ..... G01M 3/16
2006/0208915 A1 * 9/2006 Oakner ..... G01F 23/0053 340/620
2010/0162812 A1 * 7/2010 Parkinson ..... G01F 23/185 73/299
2019/0145661 A1 * 5/2019 Gardner et al. ..... F24H 15/20 122/14.3
2019/0170392 A1 * 6/2019 Powell ..... C01F 1/00
(Continued)

FOREIGN PATENT DOCUMENTS

CN 214148309 U 9/2021
JP H07217970 A 8/1995
(Continued)

OTHER PUBLICATIONS

Sakaguchi, Multiple Optical Axis Photoelectric Sensor, Sep. 6, 2007, JP 2007227392 A, Whole Document (Year: 2007).*
(Continued)

*Primary Examiner* — Elizabeth J Martin
*Assistant Examiner* — Adam Dorrel Moore
(74) *Attorney, Agent, or Firm* — Muncy, Geissler, Olds & Lowe, P.C.

(57) ABSTRACT

A sensor device for detection of water, comprising an elongate sensor body with a proximal end and a distal end. At least two sensor elements are arranged at different longitudinal positions along the length of the sensor body. The sensor body comprises at least one elastically flexible section.

10 Claims, 6 Drawing Sheets

(56) References Cited

U.S. PATENT DOCUMENTS

| | | | | |
|---|---|---|---|---|
| 2019/0350475 | A1* | 11/2019 | Dietz | A61B 5/291 |
| 2020/0166390 | A1* | 5/2020 | Ainger | G02B 6/4459 |

FOREIGN PATENT DOCUMENTS

| | | | | | |
|---|---|---|---|---|---|
| JP | 2007227392 | A | * | 9/2007 | |
| JP | 2014215179 | A | | 11/2014 | |
| WO | WO-9110116 | A1 | * | 7/1991 | G01F 23/22 |

OTHER PUBLICATIONS

Extended European Search Report dated Oct. 10, 2023 in corresponding application 23175591.9.

* cited by examiner

SENSOR DEVICE AND CONDENSATE WATER REMOVAL DEVICE

This nonprovisional application claims priority under 35 U.S.C. § 119(a) to German Patent Application No. 10 2022 113 586.1, which was filed in Germany on May 30, 2022, and which is herein incorporated by reference.

BACKGROUND OF THE INVENTION

Field of the Invention

The present invention relates to the field of sensor devices with or in combination with condensate water removal devices.

Description of the Background Art

Devices, systems and equipment from the field of heating, ventilation, air conditioning and refrigeration—which are collectively referred to as 'HVACR-systems' throughout this document—comprise refrigeration cycles with condenser units or similar units. These condensers tend to produce condensate water, which is typically collected by a so-called drip tray or condensate water tray, that is arranged below the condenser.

For the sake of clarification, the previously introduced term 'HVACR-systems' shall apply in particular, but not exclusively, to any kind of air conditioners, (gas) heaters, thermal heat pumps, condensing (gas) boilers, and so on.

If increasing amounts of condensate water accumulate in the drip tray of a HVACR-system, it can lead to overflow of the condensate water and can seriously damage the HVACR-system and/or the building or structure, where the HVACR-system is installed. Furthermore, if the condensate water remains in the drip tray for longer periods of time, mould and/or algae can form inside the drip tray, generating unpleasant odours and/or even air pollution that is hazardous to health.

It is therefore necessary to remove the condensate water from the drip tray. For smaller and/or portable HVACR-systems, the drip tray may be manually removable so that a user may empty the drip tray periodically. Other units, especially those with non-removable drip trays, support the removal of the condensate water via a drain. Typically, a condensate water hose (also referred to as condensate water tube or pipe) will be connected to a drain port of the drip tray and condensate water is removed via this hose. In some installations it is possible to root the condensate water hose in a way that allows the condensate water to be drawn from the drip tray through the condensate water hose by gravity (hence, a so called 'gravity drain'). However, it is often not possible to root the condensate water hose accordingly, so a condensate water removal device needs to be connected to the condensate water hose or pipe. It will remove the condensate water from the drip tray and will convey it towards a drain.

Many kinds of such condensate water removal devices are known in the field, from many different manufacturers. Typically, they are referred to as condensate pumps. To improve efficiency and extend service life of such devices, it is well known that it is particularly useful to combine a condensate water removal device with a component to sense the presence of condensate water or even the amount of present condensate water or to incorporate such means with the condensate water pump. Such devices are referred to as 'condensate water removal devices' throughout this document.

In the technical field, various designs have been established which implement this feature and which are explained below on the basis of some product examples of the applicant:

The REFCO COMBI condensate pump with its separate pump unit and water sensor unit is an example for a setup that is referred to as 'split pump set' throughout this document. The condensate water sensor unit is connected to the drain port of the drip tray by a first condensate water hose or pipe. For this, it comprises an inlet connector with an inlet hole. A housing of the water sensor unit forms a reservoir, that receives the condensate water from the first condensate water hose or pipe. A water sensor is arranged inside this reservoir, to sense the presence and/or amount of water inside the reservoir. While the REFCO COMBI uses an electrical sensor to detect the condensate water, systems with float switches are used by most condensate water sensor units in the market today, although they are prone to failure because of getting stuck and/or because of non-planar installation. When the water sensor detects the presence of water (or a certain amount of water) inside the reservoir, it will provide a signal or indication to the pump unit, typically by ways of an electronic connection between both units. Furthermore, both units are connected to each other by a second condensate water hose or pipe. Activated and/or controlled by the signal of the water sensor unit, the pump unit will start pumping, removing the water from the reservoir of the water sensor unit and conveying it towards a drain.

The REFCO KAROO condensate pump with its integrated water sensor and pump unit is an example for a setup, that is referred to as 'submersible pump' throughout this document. Such devices comprise an opening or several openings, that allow condensate water to enter an input opening of the pump, when the pump is submersed in water, e.g., placed at the ground of a drip tray which is filled with condensate water. A water sensor attached to the unit detects the presence and/or depth of condensate water surrounding the submersible pump and will activates the pump to remove the condensate water, if any water is present or reaches a set limit value.

The above-mentioned setups use a water sensor to sense the presence and/or amount of condensate water, thereby enabling an automatic and efficient control of the pumps.

SUMMARY OF THE INVENTION

It is therefore an object of the present invention to provide improvements for water sensor devices, i.e. sensors, and for condensate water removal devices, i.e. water removers, that use water sensors, that allow even more flexible and versatile uses of such devices, and to provide methods for commissioning of that improved devices.

According to an aspect of the invention, a sensor device for detection of water comprises at least one elongate sensor body, which extends between a proximal end and a distal end, and at least two sensor elements, arranged at different longitudinal positions along the length of the elongate sensor body, wherein that sensor body comprises at least one elastically flexible section.

That the sensor device is 'for detection of water' can mean that it is adapted to detect the presence and/or amount of water in its direct vicinity as described in more detail in the following. Therefore, it is particularly useful, e.g., to detect condensate water as part of a condensate water removal device, as described in following sections.

The term 'elongate' can mean that the sensor body has a size in one direction that is greater than its size in all other directions. This greatest dimension extends between the proximal end and the distal end. Particularly, this greatest or longest dimension is at least two times bigger than the other dimensions. Throughout this document, when the 'length' of the elongate sensor body is mentioned, that shall refer to this biggest dimension of the sensor body. The sensor body can be at least 2.5 cm long, particularly at least 10 cm long. A sensor body with a length of about 2.5 cm is particularly useful in applications where the sensor device is introduced into a drain port of a water container, e.g., a drip tray. The accumulation of water in or around the drain can be measured effectively, while the dimensions of the device can be kept small. In applications where the sensor device is introduced into a channel, e.g., into a condensate water hose, a lengthier device is useful, as a wider distance of hose can then be covered with sensor elements.

Throughout this document, the 'distal' end can be understood as that end of the elongate sensor body which is faced towards the space or volume, where the presence or amount of water is to be detected. The 'proximal' end can be understood as the other end of the elongate sensor body, opposite of the 'distal' end, which is faced away from the volume or space where the presence or amount of water is to be detected. Thus, with respect to the above-mentioned examples where the elongate sensor body is used to detect water in drip tray or inside of a condensate water hose, the distal end will be the first end to be introduced into such drip tray or hose. The proximal end, at the other end, might be attached to other devices, e.g., to a condensate water removal device, as described in following sections.

As at least two sensor elements are positioned at different positions along the length of the elongate sensor body, the sensor device can be used to place sensor elements at two or more different locations at the same time, thereby enabling accurate measurement and detection of water and/or or other environmental conditions at multiple positions. Particularly, at least three sensor elements are positioned at different positions and equally distributed over the length of the elongate sensor body. That allows for very reliable, accurate, economic and safe application of a condensate water removal device or condensate water sensor unit, as described further below. Particularly, the sensor elements are arranged in or on the elongate sensor body such that they are positioned close to an outer surface of the sensor body, within or flush with that surface or even slightly protruding outwards through the surface of the sensor body. Therefore, precise measurement of environmental conditions and/or physical parameters of surrounding fluids is possible, with fast response times. In particular, the presence and/or amount of water at and/or surrounding the elongate sensor body can be detected.

The elastically flexible section of the elongate sensor body allows the sensor device to be adaptable to many different applications and geometries, as will be described in more detail in the following sections. Throughout this document, when the sensor body as a whole or a section of it is described as 'flexible' that can mean that it can be bent in any given direction or at least in one direction, i.e., in one plane. Alternatively, or additionally, 'flexible' can mean that the flexible section is stretchable and/or compressible and/or extendible.

In an example, in which the sensor body comprises a flexible section that extends only over a defined part of the length, i.e., the section does not cover the whole length of the sensor body, that might also be referred to as a sensor body that is flexible 'at least in part'.

In an example, in which the flexible section covers essentially the full length of the elongate sensor body, that may also be referred to as an essentially completely elastically flexible sensor body.

In an example, the one or more flexible sections is/are elastically bendable, at least in one direction, e.g., in one plane. Particularly, the flexible section is elastically bendable in any direction.

In an example, the flexible section may be formed of a rubber, a silicone, an elastomeric or a thermoplastic material. Particularly, the whole elongate sensor body is formed of that material. Therefore, the sensor body can be manufactured at low cost while at the same time providing the necessary flexibility, durability and a high resistance to environmental influences like water ingress. The sensor device may comprise a completely flexible printed circuit board, wherein all sensor elements are arranged on that board, or it may comprise a rigid flexible printed circuit board, wherein all sensor elements are arranged on rigid sections of that that board, or it may comprise one or more flexible wires, wherein the flexible wires are connected to each one of the sensor elements and/or connect the sensor elements with each other. Particularly, the flexible printed circuit board or the rigid-flexible printed circuit board or the sensor elements and flexible wires are incorporated into the flexible elongate sensor body. Therefore, the above-mentioned advantages of the flexible sensor body can be utilized. Alternatively, the flexible or rigid-flexible printed circuit board or the flexible wires can form the elongate sensor body themselves, therefore omitting the necessity of a sensor body as a separate part and decreasing manufacturing cost. In such examples, the flexible section is formed of the flexible printed circuit board or of a flexible section of the rigid-flexible printed circuit board, or of the flexible wires.

The term 'wires', when used throughout this document, can be intended to mean any form of wires or cables, so particularly any form of conductor lines, ribbon cables or flat cables.

The flexible section or flexible sections can cover at least 50 percent of the length of the elongate sensor body, particularly at least 75 percent, particularly at least 90 percent. Such a sensor body proves to be particularly useful, as it can be bent and adapted to different installation conditions and geometries. In an example, the flexible section covers essentially the full length of the elongate sensor body. 'Essentially' can mean, that there is one central section of the elongate sensor body, that is elastically flexible, and only short end sections at the proximal and/or distal end might be rigid. This has the advantage, that the sensor body is adaptable to the most difficult applications, as it can easily bend multiple times and in multiple directions. Short rigid end sections may be used for a reliable connection to other devices, e.g. a condensate water removal device, that uses the sensor device, and for easier handling, e.g. easy introduction into a condensate water hose.

The elongate sensor body can comprise at least one flexible section and at least one rigid section or at least two flexible sections and at least two rigid sections, wherein flexible sections and rigid sections are distributed alternatingly over the length of the sensor body. The alternating sections may be of equal length, or the length of each section could be different, tailored to specific applications. This example may be less adaptable to different applications as it is not completely flexible, however, it may provide for a sturdier and more robust device. E.g., when the elongate sensor body is introduced into a pipe or channel as described further down below, the flexible sections will enable the device to follow possible bends of the pipe or channel to a certain extent, while the risk of twisting or jamming of the sensor body is low, as the rigid sections still provide for more stability. In further examples, the sensor body can comprise at least two flexible sections with one rigid section in between them and, preferably, further rigid sections at the proximal end and the distal end of the sensor body.

The rigid section or rigid sections of elongate sensor body can be formed of a rubber, a silicone, an elastomeric or a thermoplastic material. Particularly, as already explained above, the whole elongate sensor body is formed of that material. Therefore, the sensor body can be manufactured at low cost while at the same time providing the necessary flexibility, durability and a high resistance to environmental influences like water ingress.

The rigid sections can be formed of bulk material sections of the chosen material of the sensor body and the flexible sections are formed of hollow material sections, of sections that are reduced in width or of sections that comprise ribbed cut-outs or recesses. Particularly, the material of the sensor body is chosen from the above-mentioned materials, i.e. a rubber, a silicone, an elastomeric or a thermoplastic material. This has the advantage, that rigid and flexible sections can be formed from the same material, therefore reducing complexity and costs of manufacturing.

The shape and form of the sensor body, i.e. of the rigid and the flexible sections, can be adapted to limit a maximum bending angle of the flexible sections. As an example, the flexible sections can be formed of ribbed cut-outs or V-shaped recesses, so that the ribs or opposing walls of the recesses will collide at some point, blocking the sensor body from bending any further. This can help to prevent a flexible printed circuit board section or flexible wires, which may be incorporated into the elongate sensor body, from being broken by excessive bending of the sensor body. Therefore, this further development can increase durability and overall lifetime of the sensor device.

Further, the sensor device may comprise a rigid-flexible printed circuit board, i.e. a printed circuit board with alternating rigid and flexible sections, wherein all sensor elements are arranged on that board, particularly within the rigid printed circuit board sections. Alternatively, the sensor device may comprise one or more flexible wires, wherein the flexible wires are connected to each one of the sensor elements and/or connect the sensor elements with each other. The sensor elements may each be arranged on small rigid printed circuit boards. Particularly, the flexible printed circuit board or the sensor elements and flexible wires are incorporated into the elongate sensor body, therefore utilizing the above-mentioned advantages of the sensor body, i.e. a body formed of a rubber, a silicone, an elastomeric or a thermoplastic material, that encloses and protects the printed circuit board or the wires. Alternatively, the rigid-flexible printed circuit board or the flexible wires can form the elongate sensor body themselves, therefore omitting the necessity of a sensor body as a separate part and decreasing manufacturing cost. The flexible sections can be formed of flexible sections of the rigid-flexible printed circuit board or of the flexible wires and the rigid sections are formed of rigid sections of the rigid-flexible printed circuit board or of the rigid printed circuit boards.

The flexible section can be plastically deformable. That means, when bent to a certain angle and direction, it will keep that form and will not return to a straight form, even if there are no external force or boundaries applied to it. This feature may be applied to the sensor body as a whole, or only to flexible sections of the sensor body, as it was also described in previous sections in the context of elastic flexibility. Alternatively, the elongate sensor body—or at least one of the flexible sections of the sensor body—may comprise a deformation member, which is plastically deformable. Such a deformation member is particularly useful, when the sensor body itself is elastically flexible and cannot stay in a certain shape or form, when it is not subject to external forces or boundaries. One or more deformation members can be connected to the elongate sensor body; particularly, one or more deformation members are directly incorporated into the sensor body. A deformation member may be formed of a metal strand, or of a conductor line on a flexible printed circuit board, a flexible printed circuit board section itself or of a plastically deformable printed circuit board itself. If the elongate sensor body is plastically deformable—either by itself or by way of a comprised deformation member—the sensor device can be used to sense water and/or water levels in an even wider variety of applications, some of which will be described in following sections.

The width of the elongate sensor body can be adapted to loosely fit into a condensate water hose of an HVACR system and/or through a drain port of a condensate water tray or water container of an HVACR system. Particularly, the elongate sensor body has a width of equal to or less than 25 mm or equal to or less than 16 mm to meet the above-mentioned requirement for most of the condensate water hoses or drain ports in the field today. As will become apparent from the following sections, this is particularly useful when the sensor device is part of a water sensor unit or condensate water removal device, as it allows the sensor device to be used in completely new applications/situations.

The sensor device can also comprise a flexible section that is elastically stretchable and/or compressible and/or extendible. Therefore, the sensor device is adaptable to a wider variety of applications, as the length can be increased or decreased. For example, because of this flexible section, the length of the elongate sensor body can be stretching/compressing and/or extending, between lengths of 2.5 cm and 5 cm or between lengths of 5 cm and 15 cm or between lengths of 10 cm and 40 cm.

The extendible flexible section can comprise an extendible corrugated hose section. Particularly, the corrugated hose is arranged between rigid and/or non-stretchable, non-compressible, non-extendible sections of the elongate sensor body, where the sensor elements are positioned. Within the extendible corrugated hose, flexible wires are arranged for connection to/interconnection between the sensor elements. For example, flexible wires in the shape of coil springs can be used, so that the wires are able to adapt to the changes in length without damage. Particularly, the corrugated extendible hose comprises multiple hose segments, wherein each hose segment is manually operable from a stable folded state, with a smallest extension, to a stable extended state, with a biggest extension. Therefore, the overall length of the corrugated hose section can be increased step-by-step, which allows for a very versatile use of the sensor device.

The proximal end of the elongate sensor body can be connected to a front face of an inlet connector of a condensate water removal device. That connection may be formed of glue, a screw connection, a press-fit or positive fit connection, a material connection or any other suitable mechanical connection. By connecting the sensor device to the inlet connector of a condensate water removal device, the presence and/or amount or level of water close to that inlet connector and at several other locations along the length of the elongate sensor body can be detected in a reliable and accurate manner. Such detection information can then be used to control the condensate water removal device in an economic and effective manner.

The elongate sensor body may be rotatably mounted to the front face of the inlet connector, such that it can be rotated around a central axis of the elongate sensor body and/or an axis parallel to a central axis of the inlet connector. That is particularly useful, when the elongate sensor body is only bendable in one plane/direction. Combined with the freedom of rotation, the sensor device can be used in many different applications.

The inlet connector can be adapted to sealingly fit into a condensate water hose of an HVACR system and/or a drain port of a condensate water tray or condensate water container of an HVACR system. In combination with the previously mentioned example of the sensor device, wherein the sensor body is adapted to loosely fit into these geometries (hose and/or drain port), completely new possibilities of application arise.

In an application, the sensor device can be introduced into a condensate water hose until the open end of that hose meets with and is sealed by the inlet connector of the condensate water removal device. As the sensor body is deformable, i.e. elastically flexible of plastically deformable, it can easily adapt to the shapes and bends of the hose. The sensor device can be used to detect the presence and/or increasing amount of condensate water directly inside the condensate water hose. No additional reservoir for collection and detection of condensate water is needed in the condensate water removal device. That device can therefore be designed much smaller and condensate water can be detected faster. Also, maintenance becomes easier, as there are less parts that need regular cleaning, when there is no reservoir in the device anymore.

In another exemplary application, the sensor device can be introduced and lead through a drain port of a condensate water tray or condensate water container of an HVACR system, until the drain port meets with and is sealed by the inlet connector of the condensate water removal device. For this application it is particularly useful to implement the exemplary sensor device that comprises a plastically deformable flexible section, an elongate sensor body, that is entirely plastically deformable, or a deformation member. With that, the sensor body can be aligned and adjusted properly inside the tray or water container, to meet with the requirements of the given height of the tray and/or orientation and location of the drain port.

The inlet connector of the condensate water removal device particularly comprises an inlet hole, through which condensate water may enter (or be sucked into) a fluid channel system inside the housing or one of the housings of the condensate water removal device. The fluid channel system particularly comprises a vent, to prevent a siphon effect, when the inlet connector is connected to a condensate water hose. Furthermore, the fluid channel system comprises a condensate water pump. The pump, when activated, will draw condensate water into the inlet hole and will push it out of an outlet hole at an outlet connector of the condensate water removal device. Therefore, the sensor device must not obstruct the inlet hole.

To prevent an obstruction of the inlet hole by the sensor device, in a very simple example, the width or diameter of the elongate sensor body may be chosen smaller than the size of the front face of the inlet connector. Thereby, sensor device and inlet hole can be placed side by side and the inlet hole is not obstructed.

However, in some applications, e.g. when the sensor body should be insertable into a condensate water hose and the inlet connector should be able to sealingly fit into an open end of such a hose, it might not be possible to design the sensor device so small in width and mechanically stable at the same time. Therefore, in another example of the sensor device, the elongate sensor body comprises a groove or channel, which essentially extends longitudinal over the full length of the sensor body, wherein the groove or channel overlaps with the inlet hole at the interface between the proximal end of the elongate sensor body and the front face of the inlet connector. Preferably, the sensor elements are arranged close to, within or slightly protruding the surface of that groove or channel, thereby enabling a fast an accurate detection of the presence and/or amount of water in the groove or channel.

The aforementioned condensate water removal device can be of any known kind of such devices. For example, the condensate water removal device can be of the kind of a split-pump device. That means, the condensate water removal device comprises a sensor unit and a pump unit, which are interconnected by at least one hose as part of the fluid channel system and one wire for transfer of energy and/or sensor data between the units. The sensor device is part of a sensor unit.

However, as explained in previous sections, the innovative sensor device allows the detection of condensate water directly within a condensate water hose or in a drip tray, without requiring the condensate water removal device, e.g. the sensor unit of a split pump device, to comprise a reservoir to receive and collect condensate water. Therefore, the sensor device can be omitted while the sensor device is directly connected to an inlet connector of a small pump unit. Such a design will be referred to as an 'one-piece pump device' throughout this document. One-piece pump devices comprising the sensor device of the present invention are advantageous over the prior art, as they can be used more flexibly and are applicable even in difficult applications, where there is not much free space for the installation of a condensate water removal device.

Alternatively, the condensate water removal device can be of the kind of a submersible pump device. In such examples, the inlet connector of the condensate water removal device may be understood as any surface part of the submersible pump itself, as there is no actual connector necessary for a submersible pump to receive condensate water there through—it is simply submersed into the water. Therefore, in such examples, the sensor device can be connected to any surface part of the device, particularly close to an inlet hole, through which water may be sucked in and pumped towards a drain.

The sensor elements can be adapted to generate an electric sensor signal. That sensor signal may be a measurable as a voltage, current, capacity and/or resistance, for example. Alternatively, particularly when the sensor elements are highly integrated, the sensor signal can be a digital signal.

The sensor elements of the sensor device can comprise at least one of an optical sensor, a thermal sensor and a capacitive or conductivity sensor.

The electric sensor signal can be indicative of at least one of a presence or absence of water at sensing surfaces of the sensor elements or in contact with them, a pressure of a fluid in contact with the sensor elements, a temperature of a fluid in contact with the sensor elements, a thermal capacity of a fluid in contact with the sensor elements, and a conductivity of a fluid in contact with the sensor elements. As described in an earlier section, the sensor elements are particularly arranged close to, flush with, or protruding through a surface of the elongate sensor body. The term 'in contact with the sensor elements' as used with regard to at least this example can mean, that the water or fluid whose presence/absence, temperature, pressure, thermal conductivity or conductivity is being measured can be in contact with the surface and/or surrounds the elongate sensor body.

The sensor elements can be connected to a sensor electronics unit, wherein that sensor electronics unit either is comprised by the sensor device itself or by the condensate water removal device. Particularly, the electronics unit is adapted to determine whether or not water is present at each one of the sensor elements positions along the length of the elongate sensor body, based on the electric signal of the sensor elements. That means the electronics unit receives electrics sensor signals from the sensor elements and evaluates the signals according to predefined and/or adjustable evaluation rules. Furthermore, the sensor electronics unit may be adapted to provide an electronic control signal to an integrated pump (for example in the examples with a condensate water removal device as a one-piece pump device) or a separate pump unit (in the examples with a condensate water removal device as a split pump device).

According to another aspect of this invention, a method for commissioning of a sensor device according to any one of the previously mentioned examples, can comprise the steps of: (A) Introducing the elongate sensor body into a condensate water hose of an HVACR system or into a drain port of a condensate water tray or condensate water container of an HVACR system, (B) adding an increasing amount of water into the condensate water hose or the condensate water tray, (C) detecting the event of one of the sensor elements being the first one to detect a presence of water, (D) assigning a stop-function to that sensor element, (E) detecting the event of one of the sensor elements being the last one to detect a presence of water, and (F) assigning an alarm-function to that sensor element.

While step A obviously is a manual step, all other steps can be carried out without any further need of manual operation. Particularly, step B can be carried out by simple starting the operation of the HVACR system, which will produce condensate water automatically. When a stop-function is assigned to a sensor element, that can mean that a condensate water removal device, which comprises the sensor device, after once turned on, would be operated until that sensor elements stops indicating a presence of water. When an alarm-function is assigned to a sensor element, that can mean that the condensate removal device would be activated immediately, when that sensor element starts to indicate the presence of water. Particularly, the pump will be operated with maximum pumping power then and/or the condensate water removal device is set to an alarm state. In an alarm state, the device may be adapted to produce an acoustic and/or optically visible alarm signal.

In a further example of the above-mentioned method, which is applicable to, for example, the sensor device which comprise at least three sensor elements, the method comprises the following steps of: (D2) detecting the event of one of the sensor elements being the penultimate to detect a presence of water, and (D3) assigning a start-function to that sensor element.

The designation of that two steps as 'D2' and 'D3' indicates, that these steps are to be carried out in between of step D and step E of the previously described method. When a start-function is assigned to a sensor element, that can mean that a condensate water removal device that comprises the sensor device, would be activated immediately, when that sensor element starts to indicate the presence of water. Particularly, the pump will then be operated with a reduced pumping power. After commissioning of a sensor device according to this method, that sensor device can be used reliably to detect the presence of a certain amount of water, so that a condensate water removal device can start pumping away that water. When activated because of the electric sensor signal of a sensor element with assigned start-function, the pump will be operated with reduced power, which is sufficient to remove the water efficiently, economically and also quietly. The sensor element, to which the alarm-function is assigned, then operates as a backup, for cases where huge amounts of condensate water are produced. In that case, when the reduced pumping power is not enough and the water level rises until also the sensor element with alarm-function starts signalling the presence of water, the pump power can be increased to maximum and the condensate water is removed effectively.

All above mentioned methods for commissioning of the sensor device enable a quick and easy setup of condensate removal devices, that use such a sensor device, as it is not necessary to install the sensor device according to predefined requirements (e.g. in a way that a certain sensor element would always be the first one to get in contact with rising condensate water). Instead the device can be adapted to the spatial and directional requirements and boundaries of the application. By use of these methods, the device will teach itself how to interpret the signals from the sensor elements correctly, therefore enabling a reliable and safe operation of the sensor device/condensate water removal device.

Particularly, the electronics unit, which was mentioned in previous sections, is adapted to carry out the above-mentioned methods. In that manner, 'assigning' of certain functions to certain sensor elements can mean, that for each sensor element, that is connected to the electronics unit, a function value is stored in a memory of the electronics unit. Particularly, that memory is non-volatile. When the electronics unit receives the electric sensor signal from any one of the sensor elements and/or evaluates it to a certain result, e.g. the detection of the presence of water at the position of that sensor element, the electronics unit is adapted to execute a predefined function depending on the function value of that sensor element. Predefined functions are, for example, providing an electronic control signal to a pump unit or a measurement signal to an indication unit.

According to another aspect of the invention, a condensate water removal device for a HVACR system comprises a sensor device of any one of the above-mentioned examples, an inlet connector with an inlet hole at a front face of the inlet connector, an outlet connector with an outlet hole at a front face of the outlet connector and a pump unit.

The inlet connector is attached to a first housing. If the condensate water removal device is of the type of a one-piece pump device or a submersible pump device, the outlet connector is also attached to the first housing and the pump unit is arranged within that first housing. However, if the condensate water removal device is of the type of a split pump device, the outlet connector is attached to a second housing and the pump unit is arranged within the second housing.

The inlet hole is connected to an inlet of the pump by a fluid line and an outlet of the pump is connected to the outlet hole by another fluid line. The proximal end of the sensor device is connected to the front face of the inlet connector.

Therefore, the condensate water removal device of the present invention benefits from the advantages that have been described with regard to at least the sensor device of the present invention. It can be used in various applications, does not require an internal reservoir to collect and detect condensate water and can fit even in HVACR systems with only very little free space.

The condensate water removal device can comprise a sensor electronics unit which is connected to the sensor elements and adapted to receive electric sensor signals, that are generated by the sensor elements. The sensor electronics unit is further adapted to evaluate the received sensor signals according to predefined and/or adjustable evaluation rules. Particularly, it is adapted to determine whether or not water is present at each one of the sensor elements positions along the length of the elongate sensor body, based on the electric signal of the sensors. The result of this evaluation can be used advantageously for further control and/or signal functions.

The sensor electronics unit is adapted to perform or carry out the steps of the above-mentioned method or methods for commissioning of the sensor device and to provide a control signal to the pump unit.

Further scope of applicability of the present invention will become apparent from the detailed description given hereinafter. However, it should be understood that the detailed description and specific examples, while indicating preferred embodiments of the invention, are given by way of illustration only, since various changes, combinations and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION OF THE DRAWINGS

Figure 1:
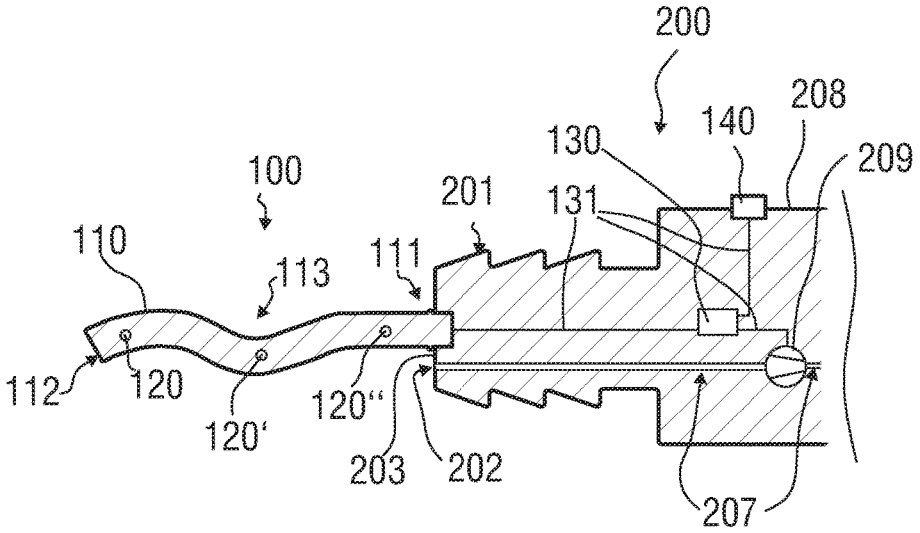
FIG. 1 schematically shows a sectional view of an example of a condensate water removal device with a sensor device, FIGS. 2A-2D schematically show different examples of an elongate sensor body of a sensor device, FIGS. 3A-3B schematically show examples of an elongate sensor body of a sensor device, FIG. 4A schematically shows an example of a condensate water removal device with a sensor device, FIGS. 4B-4C schematically show sectional views of examples of a condensate water removal device with a sensor device, FIG. 5A schematically shows a perspective view of an example of an elongate sensor body of a sensor device, FIGS. 5B-5C schematically show sectional views of an example of a sensor device with an optical sensor element, FIG. 6 schematically shows an example of a condensate water removal device with a sensor device, installed at the drain port of a drip tray of an HVACR system, FIG. 7A schematically shows an example of a condensate water removal device with a sensor device, installed at a condensate water hose of an HVACR system, and FIG. 7B schematically shows an enlarged view of an example of a condensate water removal device with a sensor device, installed at a condensate water hose of an HVACR system.

FIG. 1 shows a sectional view of an example of a condensate water removal device 200 with a sensor device 100. The sensor device 100 comprises an elongate sensor body 110 with a proximal end 111, which is connected to a front face 203 of an inlet connector 201 of the condensate water removal device 200, and a distal end 112. In this example, the sensor device 100 comprises three sensor elements 120, 120', 120", which are schematically shown as small circles, distributed along the length of the elongate sensor body 110. Each one of the sensor elements 120, 120', 120" is adapted to generate an electric sensor signal. The sensor device 100 is connected to a sensor electronics unit 130 by ways of a signal line 131. The sensor electronics unit 130 receives the electric sensor signals from the sensor elements 120, 120', 120" and is adapted to determine whether or not water is present at each one of the sensor elements 120, 120', 120" position along the length of the elongate sensor body 110, based on the electric signal of the sensor elements 120, 120', 120". Furthermore, the sensor electronics unit 130 is connected to a pump unit 209 via a control line 131, and is adapted to control/operate the pump 209 based on the result of the evaluation of the electric sensor signals. Additionally, the sensor electronics unit 130 is connected to a signal interface 140 via another signal and/or control line 131 to provide information and/or control signals to other external devices. The pump 209 is adapted to (when operated) convey water from an inlet hole 202 of the inlet connector 201 through a fluid channel system 207 to an outlet connector of the condensate water removal device 200. The electronics unit 130, the pump 209, the inlet connector 201 and the signal interface 140 are incorporated into or attached to a housing 208 of the condensate water removal device 200. The elongate sensor body 110 can comprise a flexible section 113 that is elastically bendable in at least one direction, e.g. in one plane, and that basically extends over the full length of the sensor body 110. In other words: the elongate sensor body 110 is elastically flexible itself as a whole. The elongate sensor body 110 is formed of a rubber, a silicone or an elastomeric or thermoplastic material. The sensor elements 120, 120', 120" are arranged within or on the elongate sensor body 110 such that they are positioned close to an outer surface of the sensor body 110, within or flush with that surface or even slightly protruding outwards through the surface of the sensor body 110. They are connected to each other and to the signal line 131 by flexible wires or a flexible printed circuit board.

Instead of the example of the completely flexible elongate sensor body 110 of FIG. 1, the sensor device 100 of the present invention may also comprise one of the different examples of elongate sensor bodies 110, as shown in FIGS. 2A-2D, or a combination of the features shown in these figures.

Figure 2A:
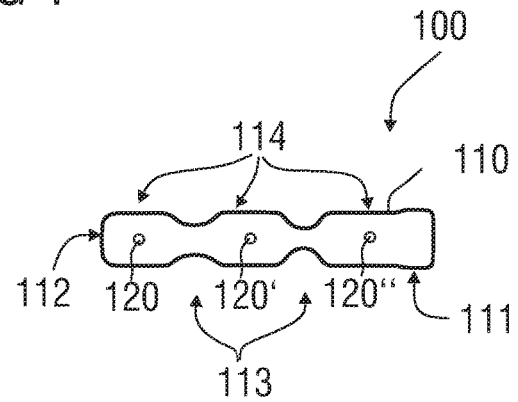

FIG. 2A shows an example of a sensor device 100 with an elongate sensor body 110, that comprises alternating rigid sections 114 and flexible sections 113. While the rigid sections 114 are formed of bulk material sections, the flexible sections 113, which are elastically bendable, are formed of sections of reduced width.

Figure 2B:
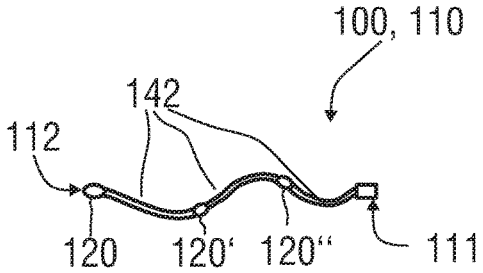
Figure 2C:
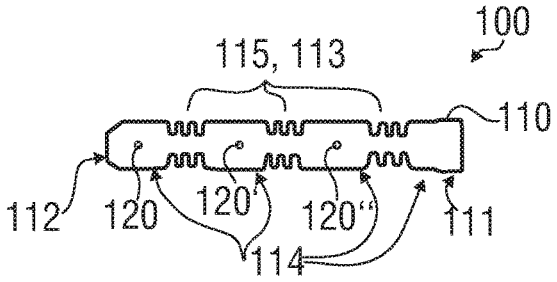

FIG. 2C shows an example of a sensor device 100 with an elongate sensor body 110, that comprises alternating rigid sections 114 and flexible sections 113. While the rigid sections 114 are formed of bulk material sections, the flexible sections 113, which are elastically bendable, are formed of sections that comprise ribbed cut-outs 115.

FIG. 2B shows an example of a sensor device 100, that comprises flexible wires 142, which connect the sensor elements 120, 120', 120" with each other. This arrangement may be incorporated into one of the elongate sensor bodies 110 of FIG. 1, 2A or 2C. However, a sensor body as a separate part may also be omitted and the flexible wires 142 and sensor elements 120, 120', 120" can form the elongate sensor body 110 themselves.

Figure 2D:
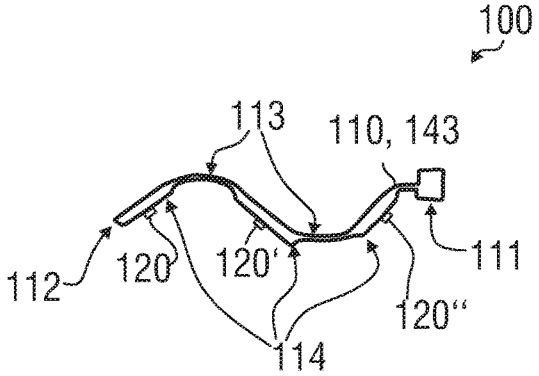

FIG. 2D shows another example of a sensor device 100, that comprises a rigid-flexible printed circuit board 143 with rigid sections 114 and flexible sections 113 that are elastically and/or plastically bendable in at least one direction. The sensor elements 120, 120', 120" are arranged on the rigid sections 114 of the circuit board 143. This arrangement may be incorporated into one of the elongate sensor bodies 110 of FIG. 2A or 2C. However, a sensor body as a separate part may also be omitted and the rigid-flexible printed circuit board 143 itself can form the elongate sensor body 110.

Figure 3A:
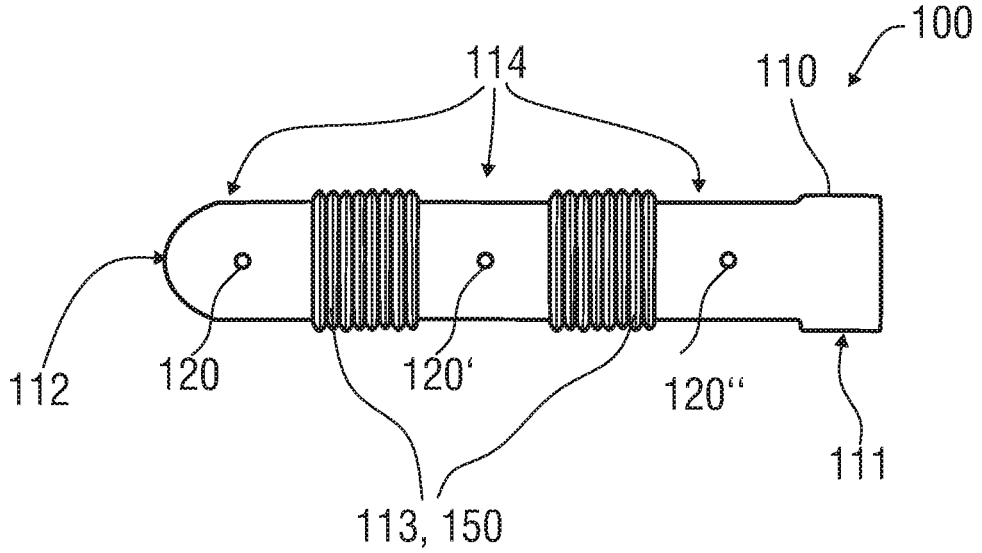
Figure 3B:
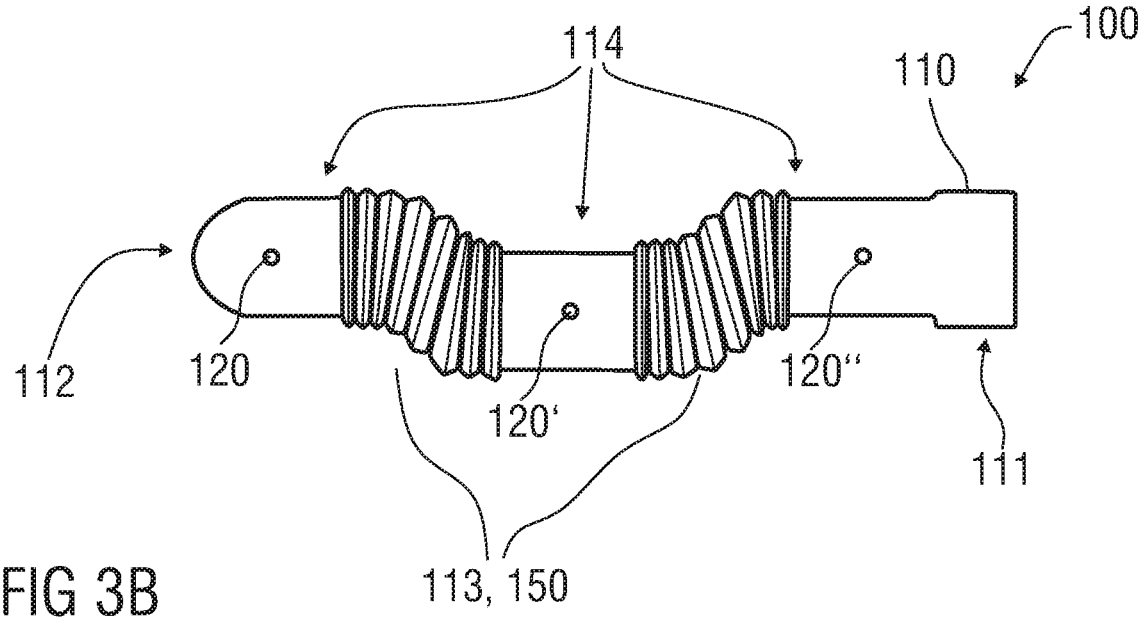

FIGS. 3A and 3B show another example of the sensor device 100, comprising flexible sections 113 that are extendible. These extendible flexible sections 113 comprise corrugated hose sections 150. The corrugated hose sections 150 each comprise multiple segments, that can be operated manually from a stable folded state with a minimum extension (see FIG. 3A) to a stable extended state with a maximum extension (see some segments in FIG. 3B). These extendible hose sections 150 can on the one hand be used to alter the length of the elongate sensor body 110 stepwise, segment by segment, and on the other hand they are elastically bendable.

Figure 4A:
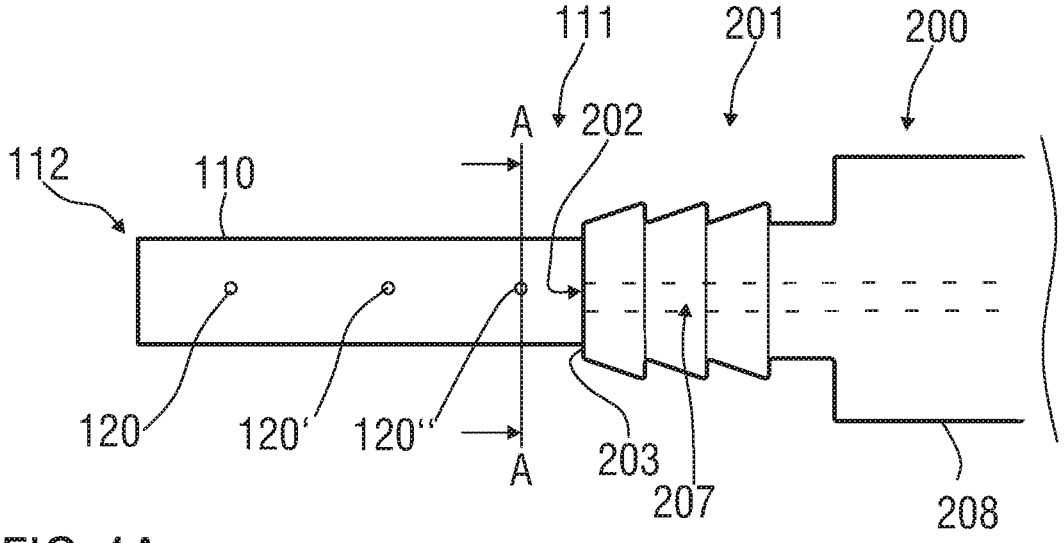

FIG. 4A shows another example of a condensate water removal device 200 with a sensor device 100. The sensor device 100 comprises an elongate sensor body 110, with a proximal end 111, which is connected to a front face 203 of an inlet connector 201 of the condensate water removal device 200, and a distal end 112. At that front face 203, the proximal end 111 overlaps with an inlet hole 202 of the inlet connector 201. The elongate sensor body 110 comprises a channel 118' of groove 118, that communicates/overlaps with the inlet hole 202. Sensor elements 120, 120', 120", schematically shown as dashed circles, are incorporated into the elongate sensor body 110, within or protruding through the surface of the groove or channel.

Figure 4B:
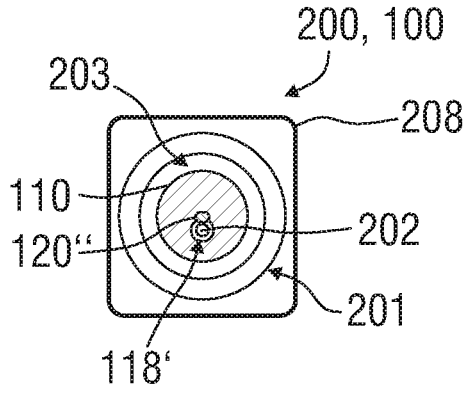

FIG. 4B shows a sectional view of an example of the condensate water removal device 200 and sensor device 100 of FIG. 4A through sectional plane A, as indicated in FIG. 4A. In this example, the elongate sensor body 110 comprises a channel 118'. Sensor element 120" is arranged adjacent to the channel 118'.

Figure 4C:
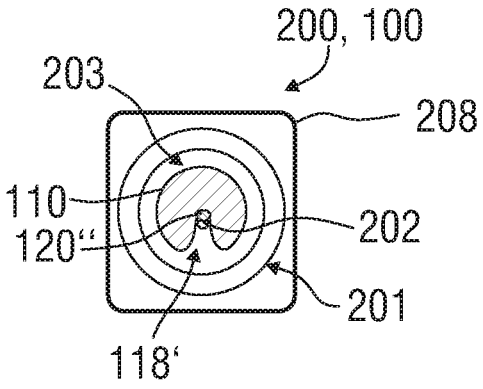

FIG. 4C shows a sectional view of another example of the condensate water removal device 200 and sensor device 100 of FIG. 4A through sectional plane A, as indicated in FIG. 4A. In this example, the elongate sensor body 110 comprises a groove 118. Sensor element 120" is arranged adjacent to that groove 118.

Figure 5A:
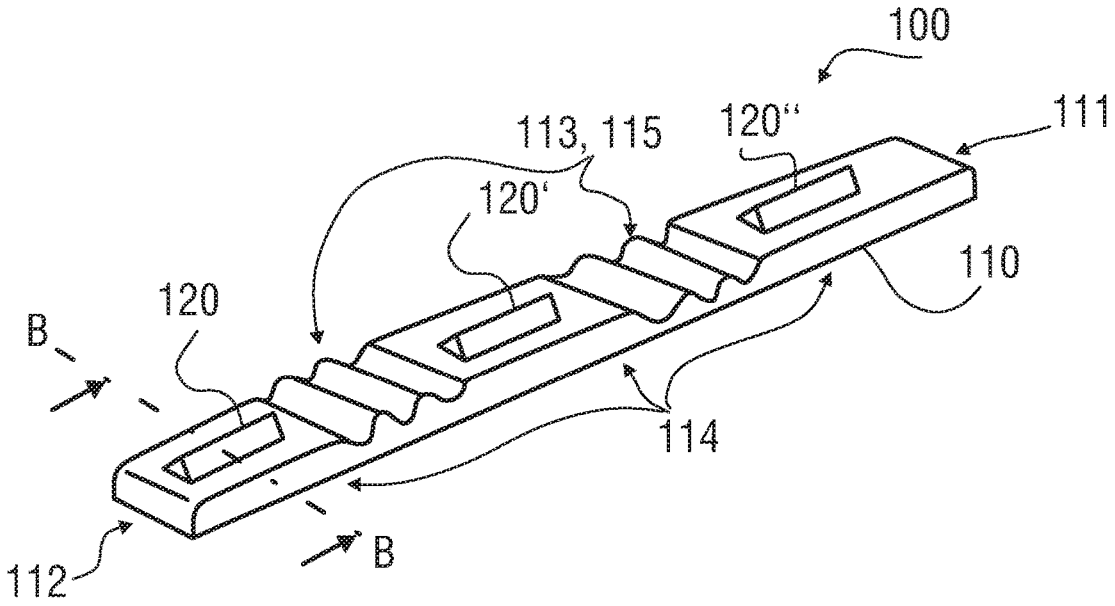

FIG. 5A shows a perspective view of an example of a sensor device 100, comprising an elongate sensor body 110 with a proximal end 111 and a distal end 112. The sensor body 110 comprises rigid sections 114 and flexible sections 113, which are formed of ribbed cut-outs 115 on a top face of the sensor body 110. Therefore, these flexible sections 113 are elastically flexible in at least one direction. The sensor device 100 comprises three sensor elements 120, 120', 120", which are optical sensors.

Figure 5B:
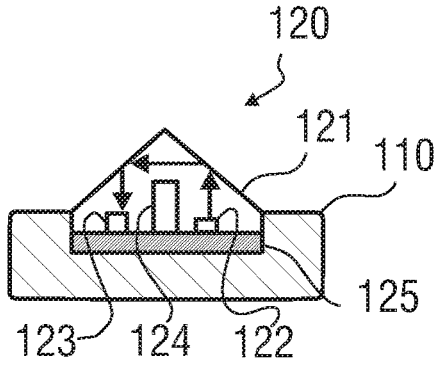
Figure 5C:
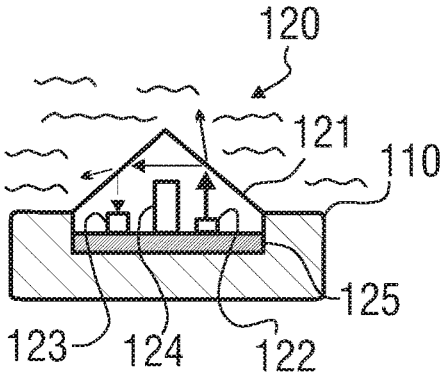

FIGS. 5B and 5C show sectional views through an example of the sensor device 100 of FIG. 5A through sectional plane B, as indicated in FIG. 5A. The optical sensor element 120 comprises a sensor prism 121, a light emitter 122 and a light receiver 123. Light from the light emitter 122 is directed towards a first reflective surface of the sensor prism 121. In FIG. 5B the sensor element 120 is not surrounded by water. The material of the sensor prism 121 and the angle of incidence of the light from the light emitter 122 are chosen such that total internal reflection occurs at the reflective surfaces of the sensor prism 121, when the sensor prism 121 is surrounded by air. Therefore, basically all light emitted by the light emitter 122 reaches the light receiver 123. In FIG. 5C however, the sensor element 120 is surrounded by water. As a result, the condition of internal total reflection is not met any longer and significant amounts of the light emitted by the light emitter 122 are refracted into the water. Therefore, the amount of light reaching the light receiver 123 decreases. A sensor electronics unit, which is connected to the sensor element 120, is adapted to determine whether or not water is present at the sensor element 120, based on the signal of the light receiver 123. A shield 124 is placed between the light emitter 122 and light receiver 123 to reduce the amount of stray light, which otherwise could reach the light receiver 123. All components are connected to a substrate 125, e.g. a rigid printed circuit board section.

Figure 6:
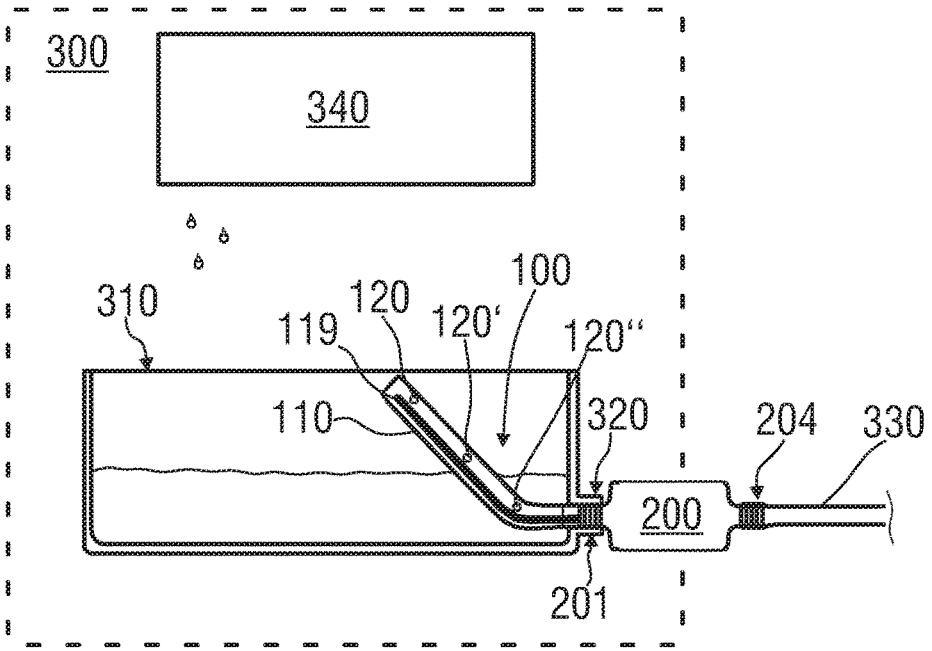

FIG. 6 shows an example of a condensate water removal device 200 with a sensor device 100, installed in a first application. An inlet connector 201 of the condensate water removal device 200 is sealingly connected to a drain port 320 of a drip tray 310 of an HVACR system 300. A source of water 340, e.g. a condenser unit of said system, produces condensate water (indicated by three drops below it), that is collected in the drip tray 310. An elongate sensor body 110 of the sensor device 100 is connected to the inlet connector 201 and protrudes into the drip tray 310. It comprises a deformation member 119, e.g. a metal strand, that allows for plastic deformation of the sensor body 110. Therefore, it can be permanently bent to an orientation, where sensor elements 120, 120', 120" are arranged at different suitable heights within the drip tray. E.g., sensor element 120" is positioned close to the ground of the drip tray 310. The sensor element 120 is positioned below the brim of the drip tray 310. The sensor element 120' is positioned between the other two.

Figure 7A:
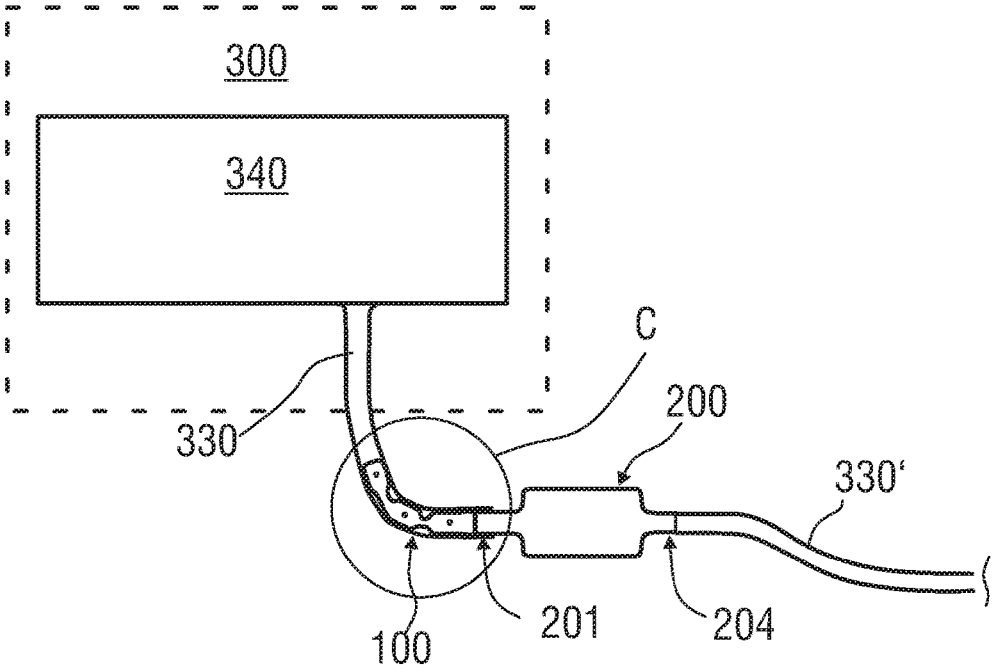

FIG. 7A shows an example of a condensate water removal device 200 with a sensor device 100, installed in a second application. An inlet connector 201 of the condensate water removal device 200 is sealingly plugged into a first condensate water hose 330, through which condensate water from a source of water 340 of an HVACR system 300 is led to the condensate water removal device 200. The condensate water removal device 200 comprises a pump that is adapted to convey water from the inlet connector 201 to an outlet connector 204, which is sealingly plugged into another condensate water hose 330', which ultimately leads to a drain. The sensor device 100 is connected to the inlet connector 201 and extends into the condensate water hose 330, to sense the presence and/or amount of water, that accumulates in the hose 330.

Figure 7B:
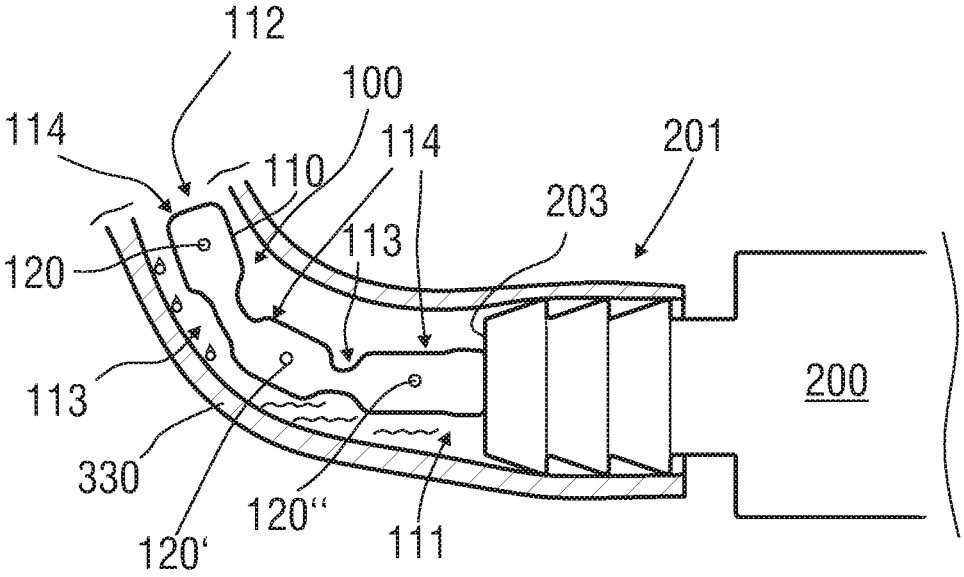

FIG. 7B shows an enlarged view of the detail area C in FIG. 7A. The sensor device 100 comprises an elongate sensor body 110 with a distal end 112 and a proximal end 111, the latter of which is connected to a front face 202 of the inlet connector 201. The elongate sensor body 110 further comprises rigid sections 114 with sensor elements 120, 120', 120" (schematically shown as circles) and flexible sections 113. The flexible sections 113 are elastically bendable, therefore the sensor device can follow the bends and curves of the condensate water hose 330 easily.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A sensor to detect water, the sensor comprising:
an elongate sensor body with a proximal end and a distal end, the elongate sensor body comprising at least one elastically flexible section; and
at least two sensor elements arranged at different longitudinal positions along a length of the elongate sensor body,
wherein the sensor elements are adapted to generate an electric sensor signal which is indicative of a presence or absence of water at a sensing surface of each one of the sensor elements, and
wherein the elastically flexible section is plastically bendable, such that when the elastically flexible section is bent, the elastically flexible section remains bent without any external forces applied thereto or the elastically flexible section comprises a deformation member, which is plastically bendable, such that when the deformation member is bent, the deformation member remains bent without any external forces applied thereto.

2. The sensor of claim 1, wherein the elastically flexible section is elastically bendable, at least in one direction.

3. The sensor of claim 1, wherein the elastically flexible section covers at least 50 percent of the length of the elongate sensor body.

4. The sensor of claim 1, wherein the elongate sensor body comprises:
one elastically flexible section and one rigid section; or
at least two elastically flexible sections and at least two rigid sections, the elastically flexible sections and the rigid sections being distributed alternatingly over the length of the elongate sensor body.

5. The sensor of claim 4, wherein the rigid sections are formed of bulk material sections, and the elastically flexible sections are formed of hollow material sections or by sections that are reduced in width or by sections that comprise ribbed cut-outs or recesses.

6. The sensor of claim 1, wherein a width of the elongate sensor body is adapted to fit into or through a condensate water hose of a heating, ventilating, air conditioning and refrigeration system ("HVACR system") or a drain port of a condensate water tray or a condensate water container of the HVACR system.

7. The sensor of claim 1, wherein the elastically flexible section is elastically stretchable, compressible or extendible.

8. The sensor of claim 1, wherein the electric sensor signal of the sensor elements is further indicative of at least one of:
a pressure of a fluid in contact with the sensor elements;
a temperature of a fluid in contact with the sensor elements;
a thermal capacity of a fluid in contact with the sensor elements; or
a conductivity of a fluid in contact with the sensor elements.

9. The sensor of claim 8, wherein the sensor elements are connected to a sensor electronics unit, and wherein the proximal end of the elongate sensor body is connected to a front face of an inlet connector of a condensate water remover and the sensor electronics unit is provided in the condensate water remover.

10. A method for commissioning a sensor according to claim 1, the method comprising:
introducing the elongate sensor body into a condensate water hose of a heating, ventilating, air conditioning and refrigeration system ("HVACR system") or into a drain port of a condensate water tray or condensate water container of the HVACR system;
adding, by a water source of the HVACR system, an increasing amount of water into the condensate water hose or the condensate water tray;
detecting an event of a first sensor element of the sensor elements being a first one to detect a presence of water;
assigning a stop-function to the first sensor element;
detecting an event of a second sensor element of the sensor elements being the last one to detect a presence of water; and
assigning an alarm-function to the second sensor element.

* * * * *